US010920804B2

(12) United States Patent
Kawabuchi et al.

(10) Patent No.: US 10,920,804 B2
(45) Date of Patent: Feb. 16, 2021

(54) HYDRAULIC SYSTEM

(71) Applicant: TADANO LTD., Kagawa (JP)

(72) Inventors: Naoto Kawabuchi, Kagawa (JP); Naofumi Yoshida, Kagawa (JP); Yasuhiro Fukumori, Kagawa (JP)

(73) Assignee: TADANO LTD., Kagawa (JP)

( * ) Notice: Subject to any disclaimer, the term of this patent is extended or adjusted under 35 U.S.C. 154(b) by 235 days.

(21) Appl. No.: 16/086,080

(22) PCT Filed: Mar. 31, 2017

(86) PCT No.: PCT/JP2017/013646
§ 371 (c)(1),
(2) Date: Sep. 18, 2018

(87) PCT Pub. No.: WO2017/171022
PCT Pub. Date: Oct. 5, 2017

(65) Prior Publication Data

US 2020/0291971 A1 Sep. 17, 2020

(30) Foreign Application Priority Data

Mar. 31, 2016 (JP) ..... 2016-070993

(51) Int. Cl.
*F15B 19/00* (2006.01)
*F15B 20/00* (2006.01)

(52) U.S. Cl.
CPC ..... *F15B 19/005* (2013.01); *F15B 20/008* (2013.01); *F15B 2211/575* (2013.01);
(Continued)

(58) Field of Classification Search
CPC ..... F15B 19/005; F15B 20/008; F15B 2211/6355; F15B 2211/87; E02F 9/2285
See application file for complete search history.

(56) References Cited

U.S. PATENT DOCUMENTS 8,554,401 B2 10/2013 Satake et al.
10,563,378 B2 * 2/2020 Moriki ..... F15B 11/17
(Continued)

FOREIGN PATENT DOCUMENTS

EP 3225751 A1 10/2017
JP H08-210307 A 8/1996

OTHER PUBLICATIONS

Oct. 9, 2019, European Search Report issued for related EP Application No. 17775553.5.
(Continued)

*Primary Examiner* — Michael Leslie
(74) *Attorney, Agent, or Firm* — Paratus Law Group, PLLC

(57) ABSTRACT

The failure detection device is a failure detection device of a pilot circuit, the pilot circuit including: a pilot pressure source; a pilot pressure supply unit that supplies pilot pressure to a control valve; a pilot oil path that connects the pilot pressure source and a pilot pressure supply unit; and a pressure control unit that controls a pressure of the pilot oil path, the failure detection device including: a pressure sensor that measures the pressure on a downstream side in a pilot pressure supply direction of the pressure control unit; and a controller that controls the pressure control unit to sequentially switch the pressure of the pilot oil path and performs a failure diagnosis based on a measurement result of the pressure sensor at this time, as an operation lever which receives an operation for operating the actuator returns to a neutral state.

2 Claims, 5 Drawing Sheets

(52) U.S. Cl.
CPC ..... *F15B 2211/6316* (2013.01); *F15B 2211/6346* (2013.01); *F15B 2211/6355* (2013.01); *F15B 2211/67* (2013.01); *F15B 2211/855* (2013.01); *F15B 2211/857* (2013.01); *F15B 2211/8636* (2013.01); *F15B 2211/87* (2013.01)

(56) References Cited

U.S. PATENT DOCUMENTS

| | | | | |
|---|---|---|---|---|
| 2017/0284056 | A1* | 10/2017 | Mizuochi | E02F 9/2285 |
| 2019/0113031 | A1* | 4/2019 | Kawabuchi | F15B 20/008 |
| 2019/0345692 | A1* | 11/2019 | Saitoh | F15B 20/008 |

OTHER PUBLICATIONS

Jun. 6, 2017, International Search Report issued for related PCT application No. PCT/JP2017/013646.
Jun. 6, 2017, International Search Opinion issued for related PCT application No. PCT/JP2017/013646.

* cited by examiner

FIG. 4

| OPERATIONAL STAGE OF HYDRAULIC CIRCUIT | CONDUCTION STATE OF SOLENOID | | STATE OF PILOT OIL PATH | | NORMAL PRESSURE | EXAMPLE OF FAILURE DETERMINATION VALUE |
|---|---|---|---|---|---|---|
| | SOLENOID VALVE FOR PILOT PRESSURE UNLOADING | SOLENOID VALVE FOR PILOT PRESSURE REDUCTION SWITCHING | SOLENOID VALVE FOR PILOT PRESSURE UNLOADING | SOLENOID VALVE FOR PILOT PRESSURE REDUCTION SWITCHING | | |
| DURING OPERATION | CONDUCTING | CONDUCTING | ON-LOAD | NON-REDUCED PRESSURE | a TO bMPa | |
| AFTER OPERATION → NON-OPERATION STATE FOR 0 TO A SECONDS | CONDUCTING | CONDUCTING | ON-LOAD | NON-REDUCED PRESSURE | a TO bMPa | PRESSURE IS OUTSIDE RANGE OF a TO bMPa |
| AFTER OPERATION → NON-OPERATION STATE FOR A TO A+B SECONDS | CONDUCTING | NON-CONDUCTING | ON-LOAD | REDUCED PRESSURE | cMPa | PRESSURE IS OTHER THAN cMPa |
| AFTER OPERATION → NON-OPERATION STATE AFTER A+B SECONDS | NON-CONDUCTING | NON-CONDUCTING | UNLOAD | REDUCED PRESSURE | 0MPa | PRESSURE IS OTHER THAN 0MPa |

HYDRAULIC SYSTEM

CROSS REFERENCE TO PRIOR APPLICATION

This application is a National Stage Patent Application of PCT International Patent Application No. PCT/JP2017/013646 (filed on Mar. 31, 2017) under 35 U.S.C. § 371, which claims priority to Japanese Patent Application No. 2016-070993 (filed on Mar. 31, 2016), which are all hereby incorporated by reference in their entirety.

TECHNICAL FIELD

The present invention relates to a failure detection device that detects a failure of a hydraulic pilot circuit that supplies pilot oil pressure to a main circuit.

BACKGROUND ART

Conventionally, hydraulic pressure is widely used in a drive system of actuators provided in industrial machines, construction machines, and the like. In a hydraulic system, a hydraulic pilot circuit is used in order to control a capacity of a variable capacity pump, control switching of a direction control valve or the like (Patent Literature 1). Since the hydraulic pilot circuit aims at signal transmission by hydraulic pressure, the hydraulic pilot circuit has a characteristic that its working pressure is low and its flow rate is also small as compared with those of the whole hydraulic circuit. Therefore, the hydraulic pilot circuit is a part susceptible to contamination (contamination of impurities) in the hydraulic circuit.

CITATION LIST

Patent Literature

Patent Literature 1: JP 8-210307 A

SUMMARY OF THE INVENTION

Problems to be Solved by the Invention

In a case where a switching valve is provided in a hydraulic pilot circuit, there may be a failure that a spool of the switching valve is stuck (fixed) due to contamination. Particularly, when a spool of a solenoid valve is stuck on an excitation side, a failure is conceivable in which the spool does not return even though it turns into a non-excitation side.

An object of the present invention is to provide a failure detection device which is capable of automatically detecting a failure of a hydraulic pilot circuit following a normal lever operation.

Solutions to Problems

A failure detection device according to the present invention is a failure detection device of a pilot circuit, the pilot circuit including:

a pilot pressure source;

a pilot pressure supply unit that supplies pilot pressure to a control valve that supplies operating pressure to an actuator;

a pilot oil path that connects the pilot pressure source and the pilot pressure supply unit; and a pressure control unit that is disposed in the pilot oil path to control a pressure of the pilot oil path, the failure detection device including:

a pressure sensor that measures the pressure on a downstream side in a pilot pressure supply direction of the pressure control unit in the pilot oil path; and a controller that controls the pressure control unit to sequentially switch the pressure of the pilot oil path and performs a failure diagnosis based on a measurement result of the pressure sensor at this time as an operation lever which receives an operation for operating the actuator returns to a neutral state.

Effects of the Invention

According to a failure detection device of the present invention, it is possible to automatically detect a failure of a hydraulic pilot circuit following a normal lever operation.

BRIEF DESCRIPTION OF DRAWINGS

FIG. 4 is a table illustrating an example of failure determination.

DESCRIPTION OF EMBODIMENTS

Figure 1:
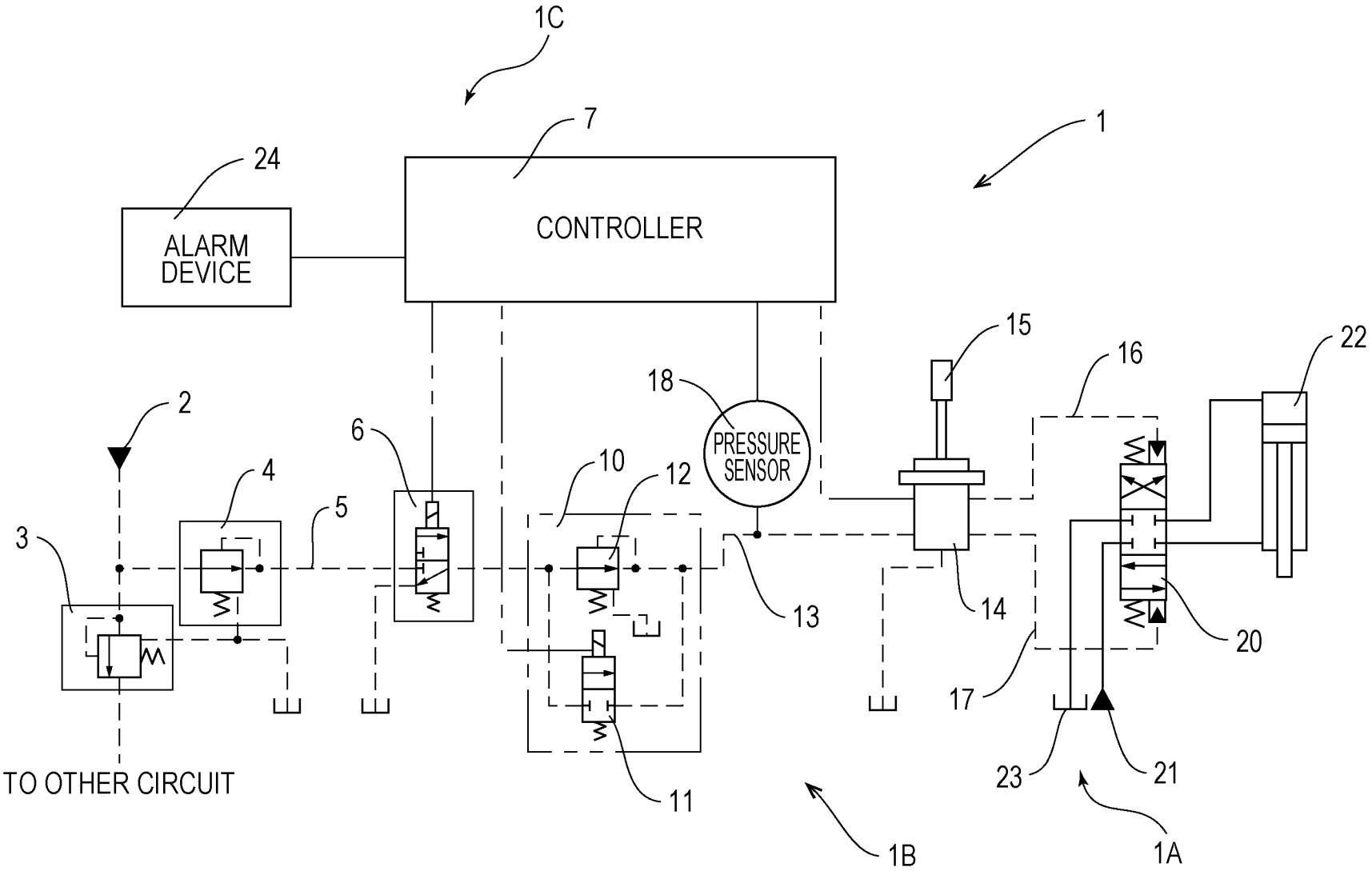
FIG. 1 is a diagram illustrating an example of a hydraulic system including a failure detection device according to the present invention.

FIG. 1 is a diagram illustrating an example of a hydraulic system 1 including a failure detection device according to the present invention. As illustrated in FIG. 1, the hydraulic system 1 includes a main circuit 1A that supplies operating pressure to an actuator 22, a hydraulic pilot circuit 1B that supplies pilot pressure to a control valve 20 of the main circuit 1A, and a failure detection device 1C that performs a failure diagnosis of the hydraulic pilot circuit 1B.

The hydraulic pilot circuit 1B includes a pilot pressure source 2, a sequence valve 3, a pressure reduction valve 4, a solenoid valve 6 for pilot pressure unloading, a controller 7, a pressure reduction unit 10, pilot oil paths 5 and 13, a remote control valve 14, and the like.

The sequence valve 3 is a pressure regulating valve that regulates a lower limit pressure of the hydraulic pilot circuit 1B. Here, it is assumed that a pressure set value of the sequence valve 3 is a [MPa]. In this case, the sequence valve 3 opens when the pressure of the pilot pressure source 2 becomes higher than the set value a [MPa], and communicates with an oil path to the other circuit.

The pressure reduction valve 4 is a pressure regulating valve that holds the hydraulic pilot circuit 1B at an appropriate pressure. Here, it is assumed that a pressure set value of the pressure reduction valve 4 is b [MPa]. The set pressure value a [MPa] of the sequence valve 3 and the set pressure value b [MPa] of the pressure reduction valve 4 have a relation of b>a. By actions of the sequence valve 3 and the pressure reduction valve 4, a pressure range of the pilot oil path 5 which comes from the pressure reduction valve 4 is kept at a to b [MPa]. For example, when the set pressure value a of the sequence valve 3 is 3.0 [MPa] and the set pressure value b of the pressure reduction valve 4 is 3.5 [MPa], the hydraulic pressure output from the pressure reduction valve 4 is 3.0 to 3.5 [MPa].

The solenoid valve 6 for pilot pressure unloading switches the hydraulic pilot circuit 1B to either an on-load state or an unload state according to a switching signal (an electric signal) output from the controller 7. Specifically, as illustrated in FIG. 1, the solenoid valve 6 for pilot pressure unloading is in a cut-off position (a state in which an output port and an input port are cut off) at non-conducting state to switch the hydraulic pilot circuit 1B to be in an unloading state. On the other hand, the solenoid valve 6 for pilot pressure unloading is in a communication position (a state where the output port and the input port are in communication) at conducting state to switch the hydraulic pilot circuit 1B to the on-load state.

The pressure reduction unit 10 has a pilot pressure reduction switching solenoid valve 11 and a pressure reduction valve 12. The pilot pressure reduction switching solenoid valve 11 switches the pilot pressure output from the pressure reduction unit 10 to either a reduced pressure state or a non-reduced pressure state in accordance with a switching signal output from the controller 7. The pressure reduction valve 12 reduces the pilot pressure output from the solenoid valve 6 for pilot pressure unloading and outputs it. Here, it is assumed that the set pressure value of the pressure reduction valve 12 is c [MPa]. The set pressure value c [MPa] of the pressure reduction valve 12 and the set pressure value a [MPa] of the sequence valve 3 have a relationship of $c<a$. The solenoid valve 6 for pilot pressure unloading and the pressure reduction unit 10 constitute a pressure control unit that controls the pressure of the hydraulic pilot circuit 1B.

The pressure reduction unit 10 is configured to switch a state of the hydraulic pilot circuit 1B between a non-reduced pressure state where the pilot pressure of a to b [MPa] is output and a reduced-pressure state where the pilot pressure of c [MPa] is output, depending on action of the pilot pressure reduction switching solenoid valve 11 according to the switching signal from the controller 7. When the pilot pressure reduction switching solenoid valve 11 is in the cut-off position, the hydraulic pilot circuit 1B is in the reduced-pressure state. When the pilot pressure reduction switching solenoid valve 11 is in the communication position, the hydraulic pilot circuit 1B is in the non-reduced pressure state. In FIG. 1, the pilot pressure reduction switching solenoid valve 11 is in the cut-off position.

The pilot oil path 5 is an oil path that connects the pressure reduction valve 4 and the solenoid valve 6 for pilot pressure unloading. The pilot oil path 13 is an oil path that connects the pressure reduction unit 10 and the remote control valve 14. The pilot pressure output from the pressure reduction unit 10 is supplied to the remote control valve 14 via the pilot oil path 13.

The remote control valve 14 is a hydraulic equipment integrally incorporated in an operation lever 15. The remote control valve 14 constitutes a pilot pressure supply unit that supplies the pilot pressure to the control valve 20. The remote control valve 14 operates in conjunction with an operation of the operation lever 15 and outputs the pilot pressure corresponding to an operation amount to the pilot oil paths 16 and 17 corresponding to an operation direction of the operation lever 15. The larger the operation amount of the operation lever 15 is, the higher the output pilot pressure is.

When the operation lever 15 is operated to enter a non-neutral state, the remote control valve 14 is opened, and the pilot pressure is supplied to the control valve 20. On the other hand, when the operation lever 15 is not operated and is in a neutral state, the remote control valve 14 is closed and the pilot pressure is not supplied to the control valve 20. The operation lever 15 detects whether an operation position is neutral or non-neutral and outputs an electric signal indicating a detection result to the controller 7.

The main circuit 1A includes a control valve 20, a hydraulic pressure source 21, a hydraulic tank 23, and the like. A driving direction of the control valve 20 is switched by the pilot pressure supplied from the remote control valve 14 via the pilot oil path 16 or 17. The control valve 20 supplies a hydraulic pressure from the hydraulic pressure source 21 to the actuator 22 and returns the oil from the actuator 22 to the hydraulic tank 23 in accordance with the switched driving direction and an opening degree.

The failure detection device 1C includes a controller 7, a pressure sensor 18, and an alarm device 24. The controller 7 controls the conduction state of the solenoid valve 6 for pilot pressure unloading and the pilot pressure reduction switching solenoid valve 11. The pressure sensor 18 measures the pressure of the pilot oil path 13, that is, a pressure on the downstream side in a pilot pressure supply direction of the pressure control unit (the solenoid valve 6 for pilot pressure unloading and the pressure reduction unit 10), and outputs a pressure signal indicating a measurement result to the controller 7. The alarm device 24 issues an alarm by an alarm signal (an electric signal) from the controller 7.

In the hydraulic system 1 having the above-described configuration, upon receiving an electric signal (an operation signal) indicating a non-neutral state from the operation lever 15, the controller 7 outputs an on-load switching signal (conduction) to the solenoid valve 6 for pilot pressure unloading and outputs a non-reduced pressure switching signal (conduction) to the pilot pressure reduction switching solenoid valve 11 of the pressure reduction unit 10. As a result, the pilot pressure (a to b [MPa]) in the non-reduced pressure state is supplied from the pilot oil path 5 to the pilot oil path 13 via the solenoid valve 6 for pilot pressure unloading and the pressure reduction unit 10. In addition, a pilot pressure corresponding to an operation amount of the operation lever 15 is output from the remote control valve 14 to the control valve 20. As a result, the control valve 20 operates to supply hydraulic oil to one of oil chambers of the actuator 22, and the actuator 22 is driven at a speed corresponding to an operation amount of the operation lever 15.

Hereinafter, a failure detection method by the failure detection device 1C will be described with reference to a flowchart illustrated in FIG. 2. Further, FIG. 3 illustrates a normal change in the pressure of the pilot oil path 13 (hereinafter, referred to as "pilot oil path pressure Pp") during a failure detection processing. It is assumed that a judgment value for failure detection is stored in the controller 7.

In step 1, the controller 7 receives from the operation lever 15 a neutral signal (an electric signal) indicating that the operation lever 15 is in the neutral state in accordance with return of the operation lever 15 to the neutral state. The controller 7 maintains states of the solenoid valve 6 for pilot pressure unloading and the pressure reduction unit 10, as they are, for A seconds after the operation lever 15 returns to the neutral state. That is, the solenoid valve 6 for pilot pressure unloading is maintained in the conducting state, and the hydraulic pilot circuit 1B is maintained in the on-load state. In addition, the pilot pressure reduction switching solenoid valve 11 is maintained in the conducting state, and the hydraulic pilot circuit 1B is maintained in the non-reduced pressure state. The state of the hydraulic pilot circuit 1B at this time is referred to as "on-load non-reduced pressure state" (a first pressure).

In Step 2, the controller 7 receives and records the pilot oil path pressure Pp (measurement result) measured by the pressure sensor 18 during A seconds in which the states of the solenoid valve 6 for pilot pressure unloading and the pressure reduction unit 10 are maintained. The pilot oil path pressure Pp at this time is referred to as "on-load non-reduced pressure Po." As illustrated in FIG. 3, the normal on-load non-reduced pressure Po is a to b [MPa].

In step 3, after a lapse of A seconds from when the operation lever 15 returns to the neutral state, the controller 7 maintains the conducting state of the solenoid valve 6 for pilot pressure unloading, and switches the state of the pressure reduction unit 10 to the reduced-pressure state (the pilot pressure reduction switching solenoid valve 11 is in the non-conducting state) and further maintains this state for B seconds. The state of the hydraulic pilot circuit 1B at this time will be referred to as "on-load reduced pressure state".

In step 4, the pilot oil path pressure Pp (measurement result) measured by the pressure sensor 18 is received and recorded during B seconds after the pressure reduction unit 10 is switched to the reduced pressure state. The pilot oil path pressure Pp at this time is referred to as "on-load reduced pressure Pr" (a second pressure). As illustrated in FIG. 3, the normal on-load reduced pressure Pr is c [MPa].

In step 5, the controller 7 switches the state of the solenoid valve 6 for pilot pressure unloading to the non-conducting state after (A+B) seconds elapse from when the operation lever 15 returns to the neutral state. The state of the hydraulic pilot circuit 1B becomes an unload state.

In step 6, the controller 7 receives and records the pilot oil path pressure Pp measured by the pressure sensor 18. The pilot oil path pressure Pp at this time is referred to as "unload pressure Pu" (a third pressure). As illustrated in FIG. 3, the normal unload pressure Pu is about 0 [MPa].

In step 7, the controller 7 compares the on-load non-reduced pressure Po recorded in step 2 with a determination value (a to b [MPa]) previously stored. If a difference between the on-load non-reduced pressure Po and the determination value is within a predetermined range, the process proceeds to step 8, and if the difference is outside the range, the process proceeds to step 12.

In step 8, the controller 7 compares the on-load reduced pressure Pr recorded in step 4 with a determination value (c [MPa]) previously stored. If the difference between the on-load reduced pressure Pr and the determination value is within a predetermined range, the process proceeds to step 9, and if it is out of the range, the process proceeds to step 12.

In step 9, the controller 7 compares the unload pressure Pu recorded in step 6 with a determination value (0 [MPa]) previously stored. If the difference between the unload pressure Pu and the determination value is within a predetermined range, the process proceeds to step 10, and if it is outside the range, the process proceeds to step 12.

In step 10, the controller 7 detects that the hydraulic pilot circuit 1B is normal, since all the determinations in steps 7 to 9 are that the differences are within the range. In step 11, the operation of the hydraulic circuit is continued as it is.

In step 12, since it is determined that one of the on-load non-reduced pressure Po, the on-load reduced pressure Pr and the unload pressure Pu is out of the range in one of the steps 7 to 9, the controller 7 detects that the hydraulic pilot circuit 1B is broken.

At this time, in step 13, the controller 7 outputs an alarm signal to the alarm device 24. The alarm device 24 alerts the failure of the hydraulic pilot circuit 1B, thereby informing the operator of the failure.

The above-described failure detection processing is executed only when the operation lever 15 is maintained in the neutral state. That is, when the operation lever 15 is in the non-neutral state during the process, the failure detection process is terminated at that point. Since the pressure state of the hydraulic pilot circuit 1B is stabilized during a non-working state where the operation lever 15 is in the neutral state, erroneous detection can be prevented and a failure can be reliably detected.

FIG. 4 is a view illustrating an operational state of the hydraulic circuit in the above-described failure detection processing, conducting states of the solenoid valve 6 for pilot pressure unloading and the pilot pressure reduction switching solenoid valve 11, a state of the pilot oil path (the pilot oil path pressure Pp) in both the solenoid valves 6 and 11 at this time, a normal pressure, and an example of failure determination value.

The failure detection device 1C can detect a failure of the sequence valve 3, the pressure reduction valves 4 and 12, and the solenoid valves 6 and 11 used in the hydraulic pilot circuit 1B illustrated in FIG. 1. In particular, it is possible to detect the failure such as disconnection or sticking due to contamination of the solenoid valve 6 for pilot pressure unloading and the pilot pressure reduction switching solenoid valve 11 which are frequently switched.

As described above, the failure detection device 1C is a failure detection device of the pilot circuit 1B including the pilot pressure source 2, the remote control valve 14 (the pilot pressure supply unit) that supplies the pilot pressure to the control valve 20 that supplies operating pressure to the actuator 22, the pilot oil paths 5 and 13 connecting the pilot pressure source 2 and the remote control valve 14, and the pressure control unit disposed in the pilot oil paths 5 and 13 for controlling the pressures of the pilot oil paths 5 and 13. The failure detection device 1C includes the pressure sensor 18 that measures the pressure on a downstream side in a pilot pressure supply direction of the pressure control unit in the pilot oil path 13, and the controller 7 that controls the pressure control unit to sequentially switch the pressure of the pilot oil path 13 and performs a failure diagnosis based on measurement results of the pressure sensor 18 at this time as the operation lever 15 receiving the operation for operating the actuator 22 returns to the neutral state.

In the present embodiment, the pressure control unit of the hydraulic pilot circuit 1B includes the solenoid valve 6 for pilot pressure unloading that switches the state of the pilot circuit to the on-load state or the unload state, and the pressure reduction unit 10 that is disposed on the downstream side in the pilot pressure supply direction of the solenoid valve 6 for pilot pressure unloading and switches the pilot circuit in the on-load state to the reduced pressure state or the non-reduced pressure state.

As described above, the failure detection device 1C sequentially controls the solenoid valves 6 and 11 of the hydraulic pilot circuit 1B for a predetermined time with the operation lever 15 returning to the neutral state as a starting point so as to reduce the pilot pressure in the hydraulic pilot circuit 1B to which the pilot pressure is supplied at the same time with the operation of the operation lever 15. In the meantime, the pressure of the pilot oil path 13 is measured and compared with the determination value, thereby performing the failure diagnosis. Therefore, the failure diagnosis of the hydraulic pilot circuit 1B can be automatically performed many times during the normal operation of the operation lever 15.

In particular, even when the solenoid valves 6 and 11 are stuck due to contamination on the switching side and no longer return, the failure can be reliably detected. It is possible to quickly take countermeasures such as trouble-shooting by detecting the failure, so it is possible to enhance the reliability of industrial machines, construction machines, etc. equipped with the hydraulic system 1.

Figure 5:
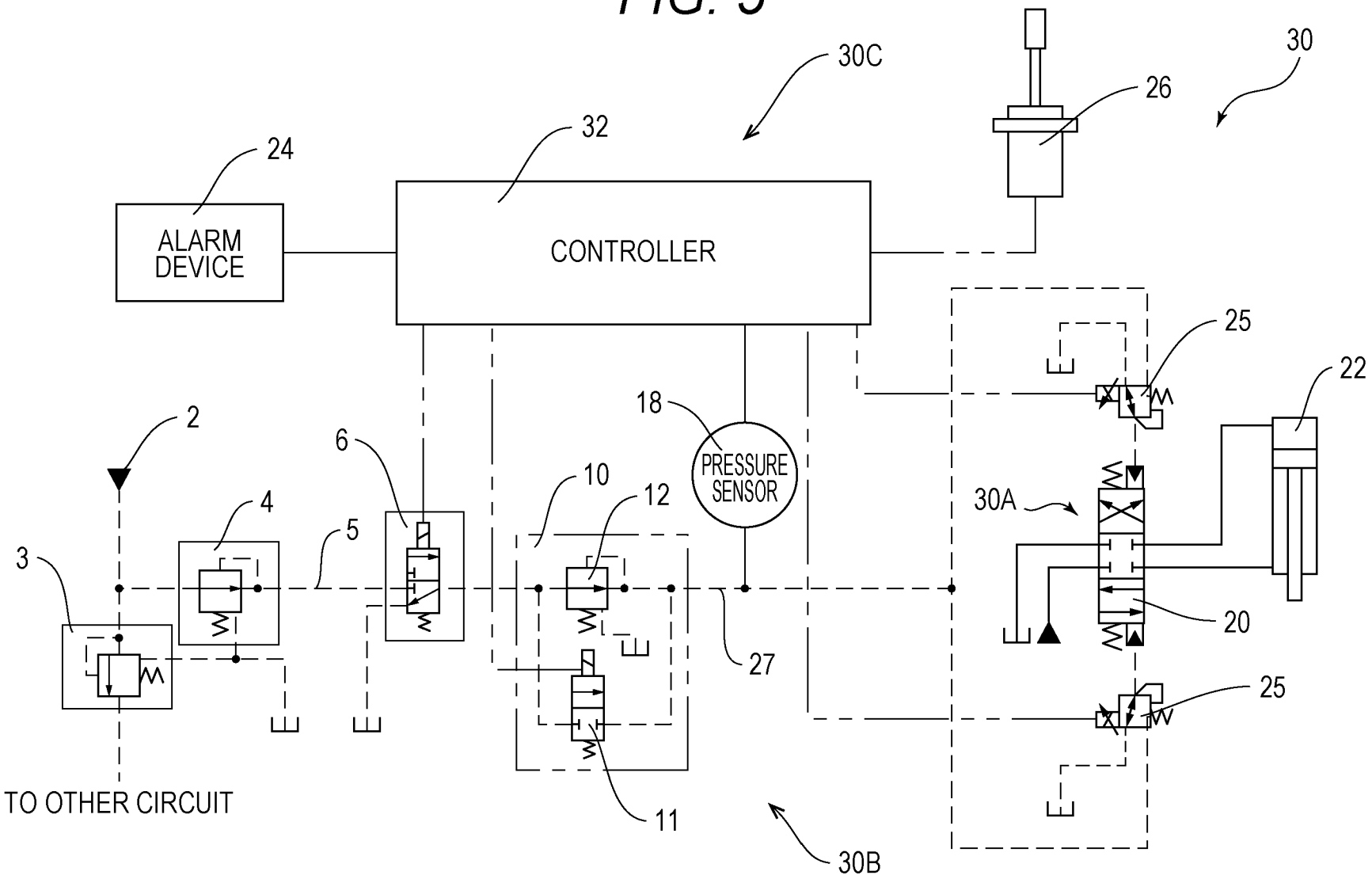
FIG. 5 is a diagram illustrating another example of a hydraulic system including a failure detection device according to the present invention.

FIG. 5 is a diagram illustrating another example of a hydraulic system including a failure detection device according to the present invention. The hydraulic system 30 differs from the hydraulic system 1 illustrated in FIG. 1 in the following two points.

The first difference is that the remote control valve 14 incorporated in the operation lever 15 supplies the pilot pressure to the control valve 20 of the main circuit 1A in the hydraulic system 1 illustrated in FIG. 1, whereas an electromagnetic proportional valve 25 of a hydraulic pilot circuit 30 B supplies a pilot pressure to a control valve 20 of a main circuit 30 A in the hydraulic system 30 illustrated in FIG. 5. That is, the electromagnetic proportional valve 25 constitutes a pilot pressure supply unit that supplies the pilot pressure to the control valve 20.

The second difference is that the operation lever 15 of the hydraulic system 1 illustrated in FIG. 1 detects whether the operation lever 15 is in the neutral state or the non-neutral state and outputs only the electric signal to the controller 7, whereas an operation lever 26 of the hydraulic system 30 illustrated in FIG. 5 outputs an operation signal (an electric signal) corresponding to an operation direction and an operation amount of the operation lever 26 to the controller 32.

In the hydraulic system 30, the controller 32 outputs a drive signal corresponding to the operation amount to the electromagnetic proportional valve 25 corresponding to the operation direction of the operation lever 26. The electromagnetic proportional valve 25 generates a pilot pressure that is proportional to the drive signal received from the controller 32 and supplies the pilot pressure to the control valve 20. As described above, the hydraulic system 30 illustrated in FIG. 5 is a circuit using a so-called electric operation system. Other configurations are the same as those of the hydraulic system 1 described with reference to FIG. 1, so the following description is omitted.

In the same manner as the hydraulic system 1 illustrate in FIG. 1, in the hydraulic system 30 illustrated in FIG. 5, when receiving the electric signal (the operation signal) indicating the non-neutral state from the operation lever 26, the controller 32 outputs the on-load switching signal (conduction) to the solenoid valve 6 for pilot pressure unloading and outputs a non-reduced pressure switching signal (conduction) to the pilot pressure reduction switching solenoid valve 11 of the pressure reduction unit 10. As a result, the pilot pressure (a to b [MPa]) in the non-reduced pressure state is supplied from the pilot oil path 5 to the pilot oil path 27 via the solenoid valve 6 for pilot pressure unloading and the pressure reduction unit 10. Further, the drive signal corresponding to the operation amount of the operation lever 26 is outputted to the electromagnetic proportional valve 25, and the electromagnetic proportional valve 25 supplies the pilot pressure generated in proportion to the drive signal to the control valve 20. As a result, the control valve 20 operates to supply hydraulic oil to one of the oil chambers of the actuator 22, and the actuator 22 is driven at a speed corresponding to the operation amount of the operation lever 26.

Figure 2:
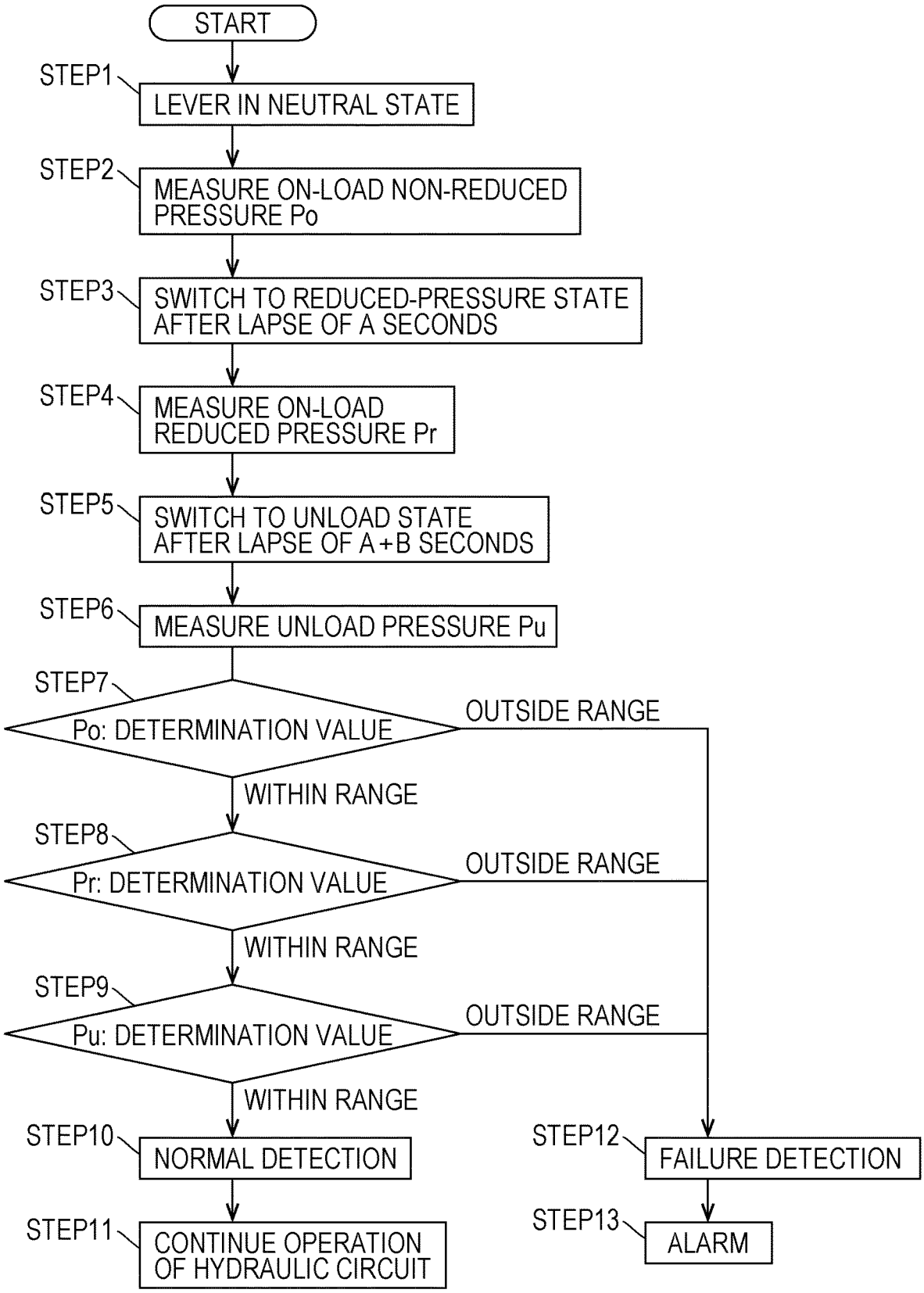
FIG. 2 is a flowchart illustrating an example of a failure detection process by the failure detection device illustrated in FIG. 1.
Figure 3:
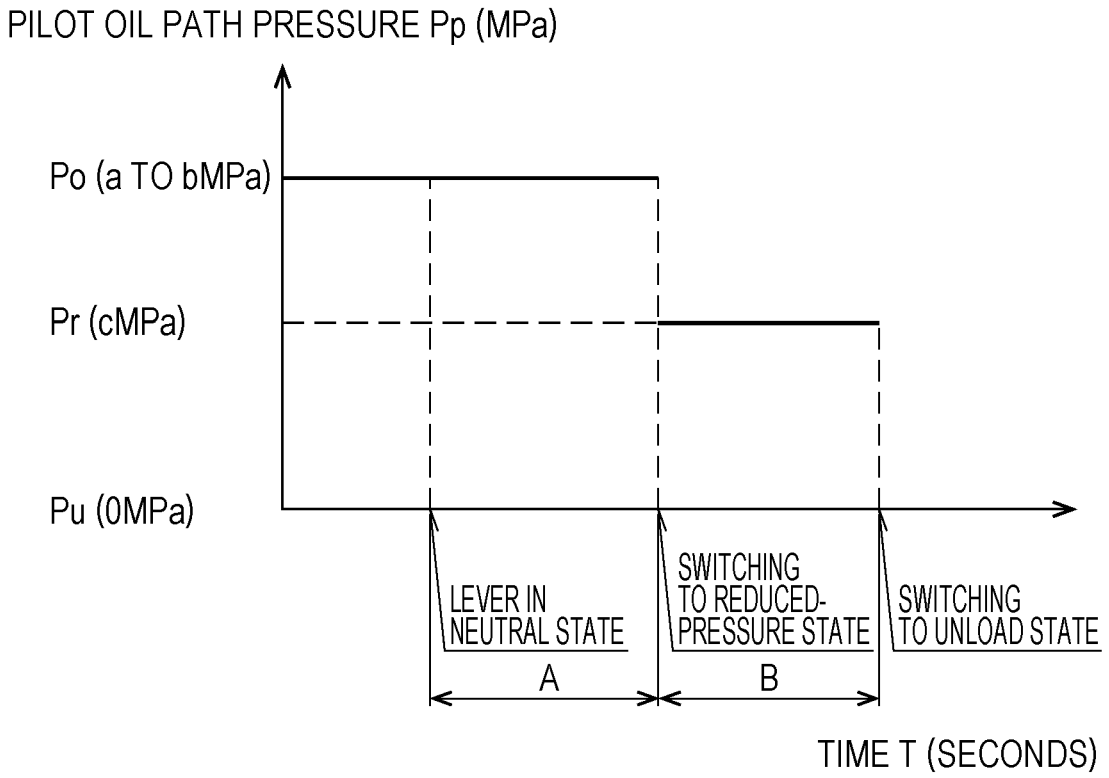
FIG. 3 is a graph illustrating a change in a normal pilot oil path pressure during failure detection.

In addition, in the hydraulic system 30 using the electric operation system illustrated in FIG. 5, failure detection processing is performed by a failure detection device 30 C according to the flowchart illustrated in FIG. 2. Therefore, in the same manner with the hydraulic system 1 illustrated in FIG. 1, the solenoid valves 6 and 11 of the hydraulic pilot circuit 30 B are sequentially controlled for a predetermined time with the operation lever 26 returning to the neutral state as a starting point, and the pilot pressure is switched. During that time the pressure of the pilot oil path 27 is measured and compared with the determination value, thereby performing the failure diagnosis. Therefore, it is possible to automatically detect the failure of the hydraulic pilot circuit 30B many times during the normal operation of the operation lever 26.

In particular, when the solenoid valves 6 and 11 are stuck due to contamination on the switching side, it is possible to reliably detect a failure. It is possible to quickly take counter measures such as trouble shooting by detecting the failure, so that a reliability of construction machines or the like equipped with the hydraulic system 30 can be enhanced.

As described above, the invention made by the present inventor has been described specifically based on the embodiments, but the present invention is not limited to the above embodiments and can be modified within a range not departing from the gist thereof.

For example, in the embodiment, the example of the hydraulic pilot circuit 1B has been described in which the pressure can be reduced in one stage by one pilot pressure reduction switching solenoid valve 11 and the pressure reduction unit 10 including one pressure reduction valve 12. However, it goes without saying that the present invention is also applicable to a hydraulic pilot circuit including a pressure reduction unit capable of reducing pressure in two or more stages as a pressure control unit. In that case, it is also possible to deal with by further changing the control method of the pilot pressure reduction switching solenoid valve and the determination value for failure detection. That is, the solenoid valve of the hydraulic pilot circuit is sequentially controlled to switch the pressure state of the hydraulic pilot circuit for a predetermined time with the operation lever returning to the neutral state as a starting point and, during that time, the pressure of the pilot oil path is measured and compared with the determination value, whereby it is possible to automatically detect the failure of the hydraulic pilot circuit many times during normal operation.

It should be noted that the embodiments disclosed at this time are examples in all respects and they are not restrictive. The scope of the present invention is not defined by the above description but by the scope of the claims, and it is intended that all modifications within meaning and scope equivalent to the claims are included.

REFERENCE SIGNS LIST

1 Hydraulic system
1A Main circuit
1B Hydraulic pilot circuit
1C Failure detection device
2 Pilot pressure source
6 Solenoid valve for pilot pressure unloading (pressure control unit)
7 Controller

10 Pressure reduction unit (pressure control unit)
11 Pilot pressure reduction switching solenoid valve
12 Pressure reduction valve
5, 13 Pilot oil path
14 Remote control valve (pilot pressure supply unit)
15 Operation lever
18 Pressure sensor
20 Control valve
22 Actuator

The invention claimed is:

1. A hydraulic system comprising:

a pilot circuit;

a pressure sensor that measures a pressure; and a controller that performs a failure diagnosis of the pilot circuit based on a measurement result of the pressure sensor, wherein the pilot circuit includes:

a pilot pressure source;

a pilot pressure supply unit that supplies pilot pressure to a control valve that supplies operating pressure to an actuator;

a pilot oil path that connects the pilot pressure source and the pilot pressure supply unit; and a pressure control unit that is disposed in the pilot oil path to control a pressure of the pilot oil path, the pressure control unit includes:

a solenoid valve for pilot pressure unloading that switches the pilot circuit to an on-load state or an unload state; and a pressure reduction unit that is disposed on the downstream side in the pilot pressure supply direction of the solenoid valve for pilot pressure unloading and switches the pilot circuit in the on-load state to a reduced pressure state or a non-reduced pressure state, the pressure sensor measures the pressure on a downstream side in a pilot pressure supply direction of the pressure control unit in the pilot oil path, and the controller controls the pressure control unit to sequentially switch the pressure of the pilot oil path and performs a failure diagnosis based on a first pressure in an on-load non-reduced pressure state after the operation lever returns to the neutral state, a second pressure in an on-load reduced pressure state after a time A elapses from when the operation lever returns to the neutral state, and a third pressure in an unload state after a time A+B elapses from when the operation lever returns to the neutral state.

2. The hydraulic system according to claim 1, wherein the controller performs the failure diagnosis by comparing the first pressure, the second pressure and the third pressure with determination values previously set to correspond thereto respectively.

* * * * *